US008607987B2

(12) United States Patent
Oja et al.

(10) Patent No.: US 8,607,987 B2
(45) Date of Patent: Dec. 17, 2013

(54) PACKAGING SYSTEM

(75) Inventors: Mari-Annika Oja, Helsinki (FI); Oliverio Cruz-Diaz, Tampere (FI); Mika Mattila, Tampere (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 13/450,714

(22) Filed: Apr. 19, 2012

(65) Prior Publication Data

US 2013/0277272 A1 Oct. 24, 2013

(51) Int. Cl.
*B65D 5/44* (2006.01)

(52) U.S. Cl.
USPC ..... 206/776; 229/117.15; 229/164; 229/107

(58) Field of Classification Search
USPC ..... 206/730, 775, 776, 734, 735, 784, 806, 206/732, 733, 471, 462, 495; 229/117.15, 229/120.38, 143, 149, 154, 164, 120.22, 229/106, 107, 116.1, 116.2
See application file for complete search history.

(56) References Cited

U.S. PATENT DOCUMENTS

| | | | | | |
|---|---|---|---|---|---|
| 624,408 | A | * | 5/1899 | Unser | 229/117.23 |
| 1,683,100 | A | * | 9/1928 | Rozowsky | 229/104 |
| 2,312,507 | A | * | 3/1943 | Trogman | 229/117.21 |
| 2,709,264 | A | * | 5/1955 | Stierlen | 4/398 |
| 2,722,361 | A | * | 11/1955 | Kindseth | 229/164.1 |
| 2,856,114 | A | * | 10/1958 | Guyer | 229/5.81 |
| 3,406,816 | A | * | 10/1968 | Green et al. | 446/73 |
| 3,675,763 | A | * | 7/1972 | Sandel | 206/387.11 |
| 3,777,883 | A | | 12/1973 | Hackenberg | |
| D235,514 | S | * | 6/1975 | Hackenberg | D9/418 |
| 3,887,067 | A | | 6/1975 | Collura et al. | |
| D250,748 | S | * | 1/1979 | Leger | D9/420 |
| 4,171,763 | A | * | 10/1979 | Card | 229/117.15 |
| D263,793 | S | * | 4/1982 | Magee | D9/433 |
| 4,362,239 | A | | 12/1982 | Roccaforte | |
| D436,859 | S | * | 1/2001 | Botsford et al. | D9/416 |
| 6,279,819 | B1 | | 8/2001 | Schultz | |
| 6,672,762 | B1 | * | 1/2004 | Faircloth et al. | 383/9 |
| D489,609 | S | * | 5/2004 | Holthaus et al. | D9/430 |
| 6,758,340 | B1 | * | 7/2004 | Feibelman | 206/775 |
| D509,733 | S | * | 9/2005 | Jongens | D9/430 |
| 7,650,997 | B2 | * | 1/2010 | Nago | 206/775 |
| 7,806,260 | B2 | * | 10/2010 | Chun | 206/320 |
| 8,225,985 | B2 | * | 7/2012 | Oliveira | 229/107 |

FOREIGN PATENT DOCUMENTS

GB 2198705 6/1988

OTHER PUBLICATIONS www.ipadpatter.com/external-news-updates/holiday-giveaway-mogo-talk-xd-for-iphone-4; Michael Rose; Holiday Giveway: Mogo talk XD for iphone 4. Published Dec. 19, 2010. pp. 1-8.

(Continued)

*Primary Examiner* — J. Gregory Pickett
*Assistant Examiner* — Mollie Llewellyn
(74) *Attorney, Agent, or Firm* — Banner & Witcoff, Ltd.

(57) ABSTRACT

A packaging system includes an outer shell having a display frame structure. A transparent or plastic container may be disposed in the outer shell. The transparent container may include mounted therein, a box insert formed from a paperboard body blank. The box insert may include a pair of laterally disposed sidewalls each including a locking slot and an arcuate portion. A front panel is disposed between the pair of sidewalls being connected by a vertical fold line at each sidewall. A display panel has laterally disposed locking tabs that are received in the locking slots of the sidewalls to cause the display panel to form a curved region supported by the arcuate portion.

16 Claims, 7 Drawing Sheets

(56) References Cited

OTHER PUBLICATIONS

Flexabox/Lucbox film for transparent boxes found at "www.gallazi-group.eu/content/en/prodotti/applications/fexabox-lucbox/"; Feb. 29, 2012. pp. 9-11.

Ministry of Sound MOS005 Headphones Gear found at www.hang-out.altsounds.com/gear/140667-ministry-sound-mos005-head-phones-gear.html ;Dec. 16, 2011. pp. 12-14.

International Search Report mailed Jul. 22, 2013 in corresponding Application No. PCT/FI2013/050425.

* cited by examiner

PACKAGING SYSTEM

FIELD

The disclosed subject matter generally relates to containers, in particular to a merchandise storage container.

BACKGROUND

In the shipping and packing industry, boxes are used for transporting products and materials to retailers or distributors. Merchandise storage containers can be used by retailers and customers in a retail environment.

BRIEF SUMMARY

There is provided, in one aspect, a packaging system including a box insert formed from a paperboard body blank, including: a pair of laterally disposed sidewalls each including a locking slot and an arcuate portion; a front panel disposed between the pair of sidewalls being connected by a foldable region at each sidewall; a display panel having laterally disposed locking tabs that are received in the locking slots of the sidewalls configured to cause the display panel to form a curved region extending between the arcuate portion.

There is provided, in one aspect, a packaging system, including an outer shell having a display frame structure. A transparent or plastic container may be disposed in the outer shell. The transparent container includes mounted therein, a box insert formed from a paperboard body blank. The box insert includes: a pair of laterally disposed sidewalls each including a locking slot and an arcuate portion; a front panel disposed between the pair of sidewalls being connected by a vertical fold line at each sidewall; a display panel having laterally disposed locking tabs that are received in the locking slots of the sidewalls to cause the display panel to form a curved region supported by the arcuate portion; the display panel being disposed within the display frame.

In one aspect, an apparatus may include a pair of laterally disposed sidewalls, at least one of the sidewalls comprising a locking slot and each of the sidewalls may include arcuate portion. A front panel is disposed between the pair of sidewalls being connected by a foldable region at least at one of the sidewalls. A flexible product panel having at least one locking tab pivotally configured for the locking slot of the at least one of the sidewalls to form a curved region extending between the arcuate portions.

BRIEF DESCRIPTION OF THE DRAWINGS

The foregoing summary as well as the following detailed description, considered in conjunction with the accompanying drawings, provides a better understanding of the subject matter, in which like reference numbers refer to like elements, and wherein.

DETAILED DESCRIPTION

Figure 1:
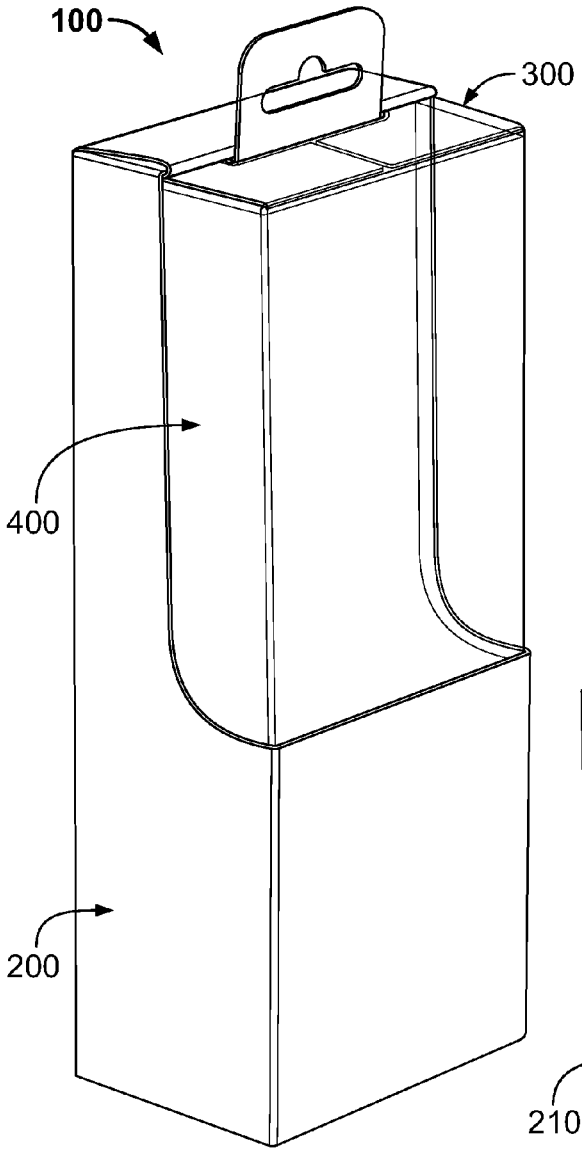
FIG. 1 is a perspective view of an assembled packaging system.

FIGS. 1-12 illustrate a packaging system, such as merchandise container for displaying an object therein for purchase or for transport. In FIG. 1, an assembly view of a packaging system is shown. In the depicted construction of a merchandise container 100 shown in FIG. 1, the construction includes an outer shell 200 housing therein a transparent container 300, and a box insert 400 configured for displaying a product.

Figure 2:
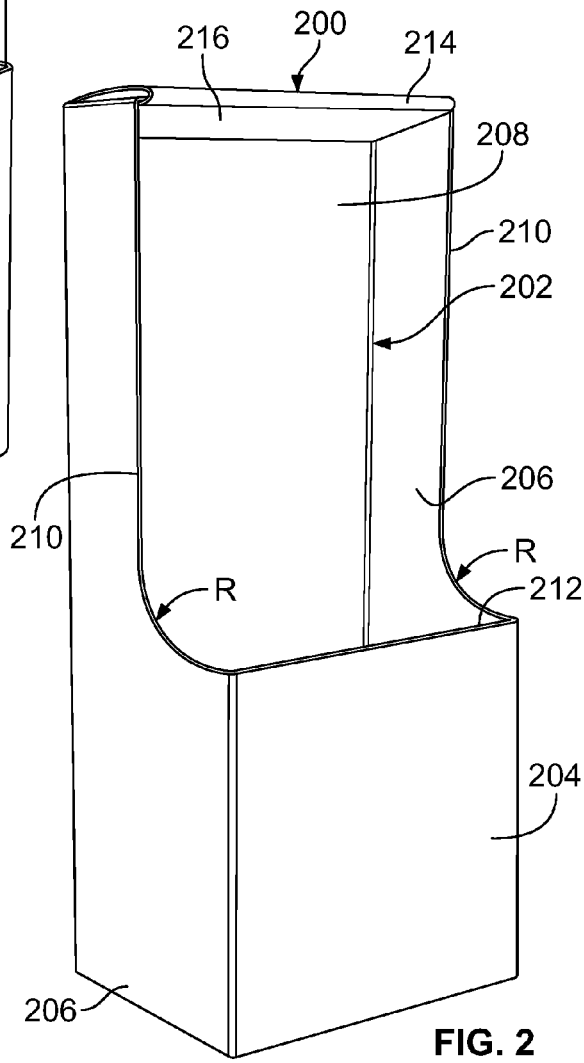
FIG. 2 is a perspective view of an outer container shell of a packaging system.

FIG. 2 illustrates an outer container shell 200 of packaging system 100. The outer shell 200 may be constructed from a one piece body blank (not shown). Nevertheless, other constructions of the outer shell 200 are possible. The outer container shell 200 includes a cavity 202 for holding the transparent container 300, and a box insert 400 within the container 300 as shown in FIG. 1. The outer container shell 200 includes a front panel 204 spanning between a pair of parallel sidewalls 206. A rear panel 208 spans between the sidewalls 206 and is disposed parallel to the front panel 204. A three dimensional display frame is created from the free side edge 210 of sidewalls 206 and free top edge 212 of front panel 204 and front edge 214 of top panel 216. The free side edges 210 of the sidewalls 206 include a radius portion R.

In the depicted construction, the cube shaped container or rectangular shaped container can be constructed of a paperboard sheet material or other sheet material, such as plastic. The container can be constructed to hold and transport any appropriate device or product, such as a mobile communication device and accessory device, for example. Nevertheless, the container can have a width height, and depth appropriate for retaining an object therein for transportation and use by the consumer or other individual. An image or images can be printed on the sidewalls of the container can be placed on the paperboard using conventional printing techniques. In accordance with concepts herein, the container shapes may be polyhedral.

Figure 3:
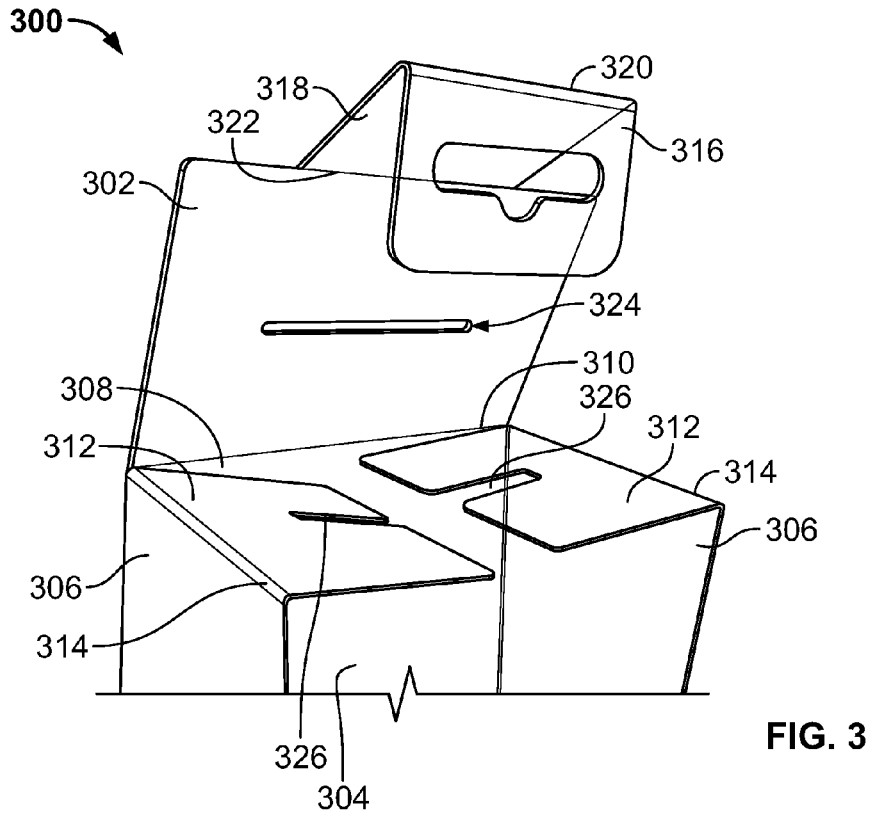
FIG. 3 is a perspective view of a transparent container in one assembled state.

Referring to FIG. 3, the transparent container 300 includes a top panel 302. A front panel 304 spans between a pair of parallel sidewalls 306. A rear panel 308 spans between the sidewalls 306 and is disposed parallel to the front panel 304. The top panel 302 is pivotally connected to the rear panel 308 by way of a flexible region, such as fold line 310. Two top flaps 312 are pivotally connected to the sidewalls 306 by way of fold lines 314. A hanging tab 316 is pivotally connected to a support panel 318 by way of fold line 320. The support panel 318 is pivotally attached to top panel 302 via a fold line 322. The top panel 302 includes centrally disposed elongated slot 324 configured to receive the hanging tab 316. The two top flaps 312 includes partial slots 326 sized and configured to align with slot 324 when the container 300 is assembled. The top flaps 312 with partial slots 326 collectively define a slot so that the hanging tab 316 may extend through.

Figure 4:
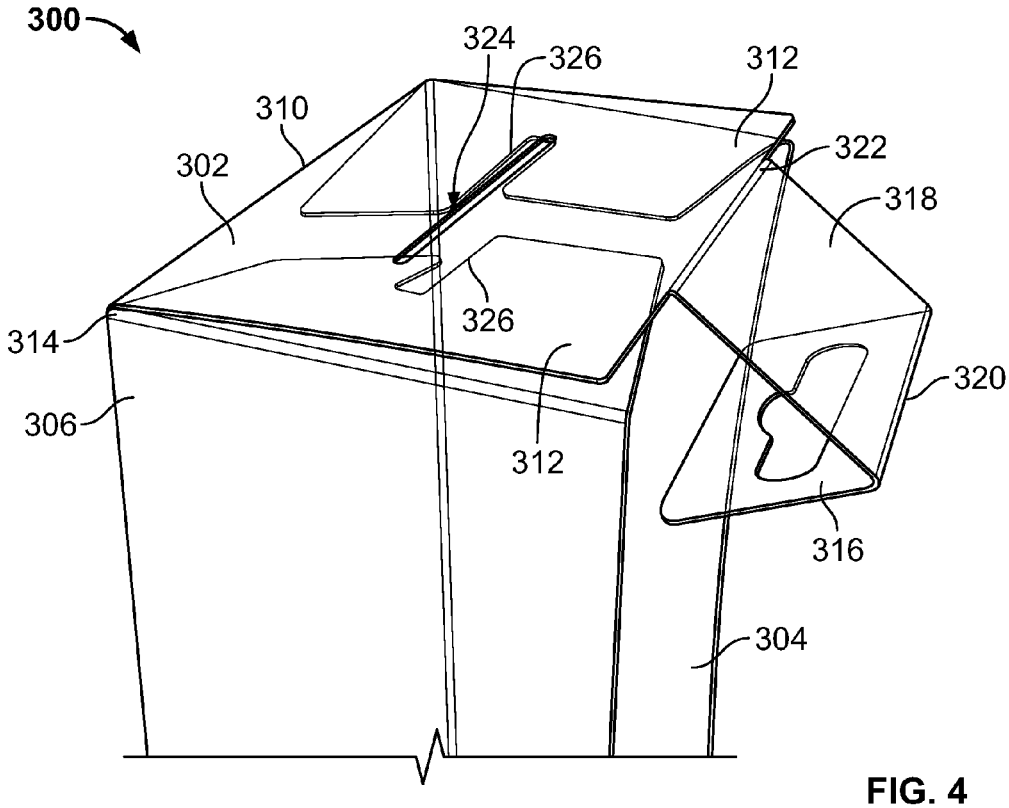
FIG. 4 is a perspective view of the transparent container of FIG. 3 in a second assembled state.
Figure 5:
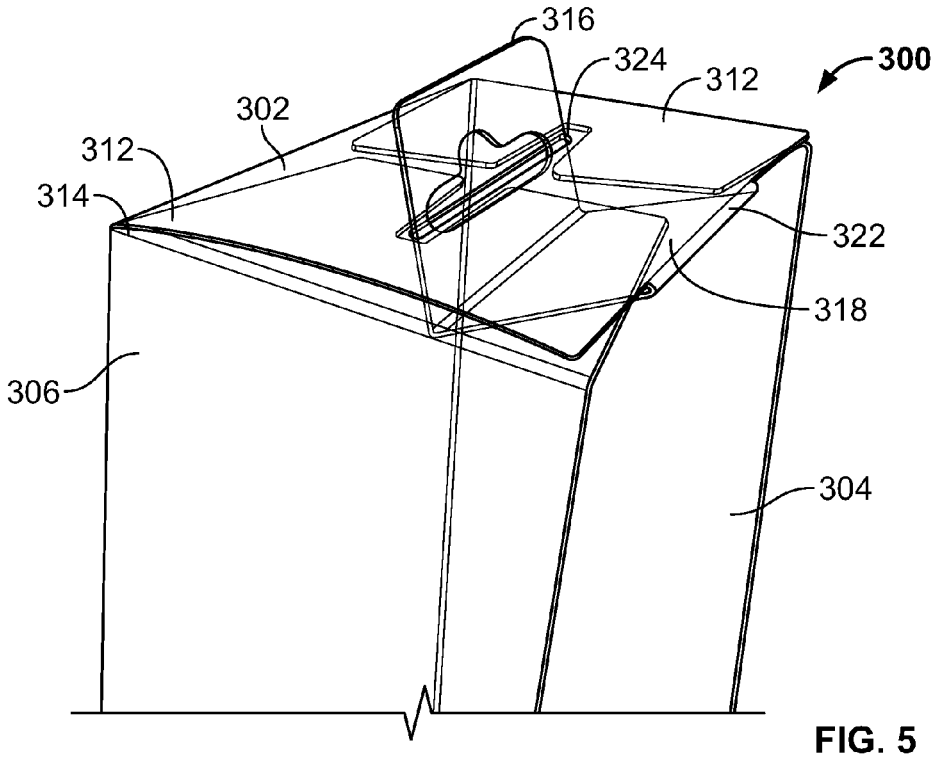
FIG. 5 is a perspective view of the transparent container of FIG. 3 in a third assembled state.
Figure 6:
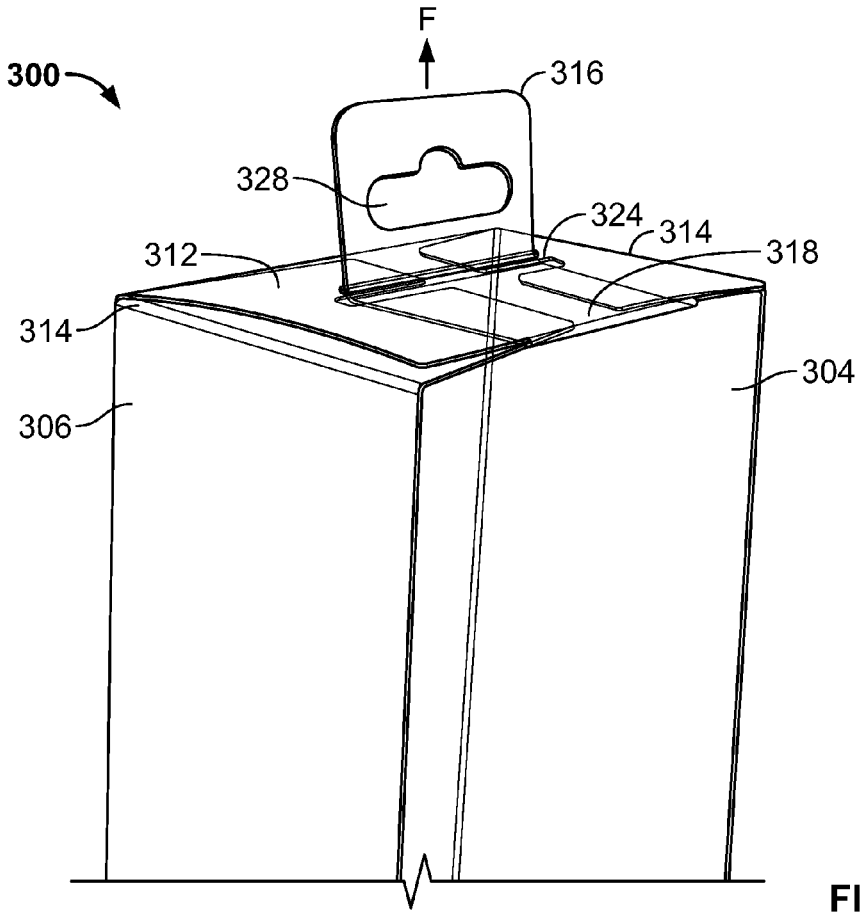
FIG. 6 is a perspective view of the transparent container of FIG. 3 in fourth assembled state.

Referring to FIG. 4, the top panel 302 is pivoted about fold line 310 clockwise to abut the top flaps 312. The support panel 318 is pivoted clockwise about fold line 322 to bring the hanging tab 316 underneath the top flaps 312 towards slot 324 in top panel 302. Referring to FIG. 5, the support panel 318 is pivoted into position underneath the top flaps 312 to enable the hanging tab 316 to be inserted through the slot opening 322 of top panel 302. As shown in FIG. 6, hanging tab 316 is provided in an assembled configuration fully inserted through slot 322. In this assembled configuration, the top panel 302 is disposed on top of top flaps 312 and the support panel 318 is disposed on the bottom of flaps 312. In this way, the flaps 312 are sandwiched between to the top panel 302 and support panel 318 to form a mechanically interlocking structure to resist an upward pull force F provided on the hanging tab 316. In this configuration, adhesive is not needed on the top panel 302, top flaps 312 and support panel 318 to maintain the interlocking function. The load of the pull force F is advantageous distributed along the surface area of the support panel 318. The hanging tab 316 includes an opening 328 to enable the transparent container 300 to hang on a rod of a display rack.

Figure 7:
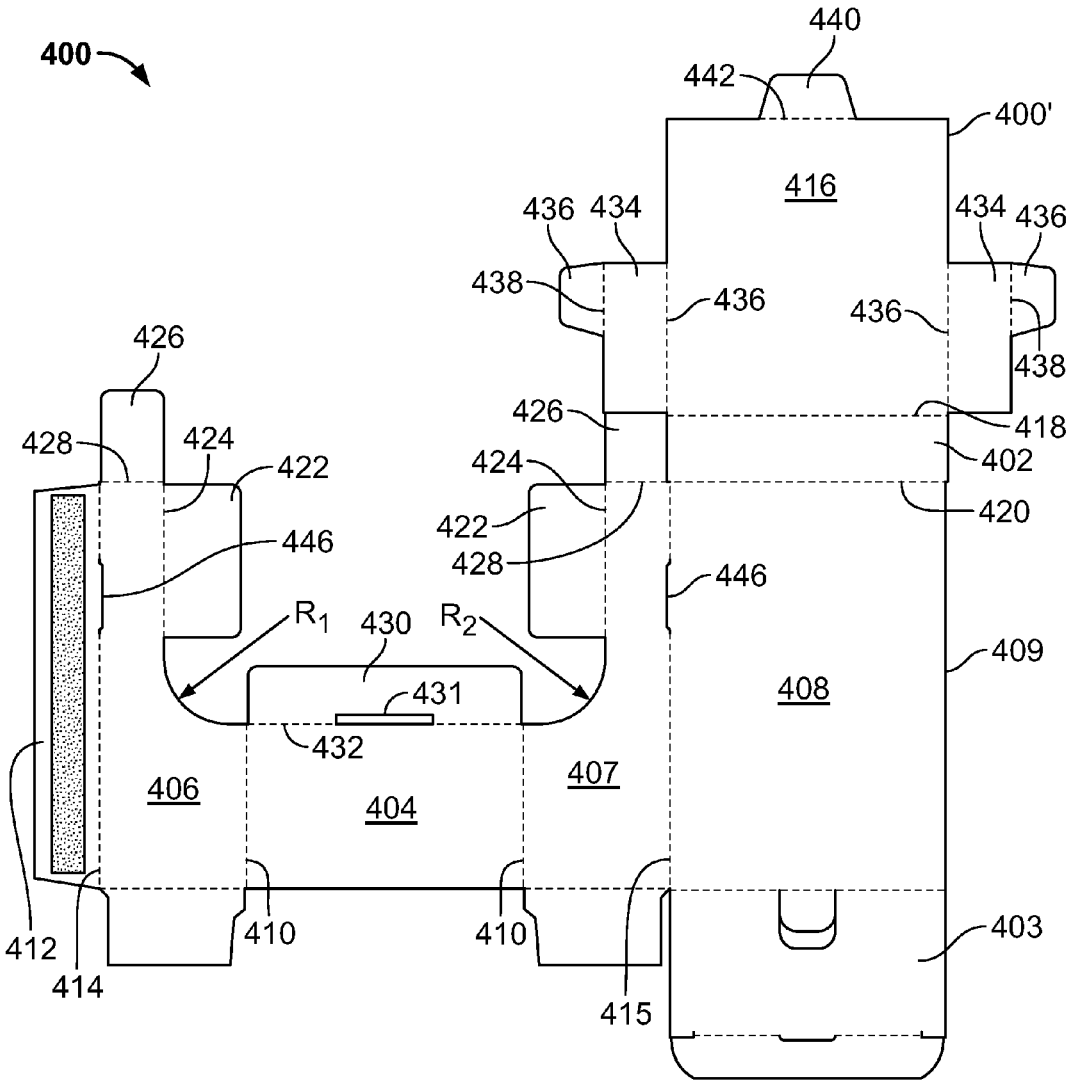
FIG. 7 is a plan view of a box insert body blank for the packaging assembly.

Referring to FIG. 7, the box insert 400 is shown in the unassembled state in the formed of a one piece box insert body blank 400' (such as a sheet of paperboard). For ease of explanation, fold lines (linear flexible or foldable regions) are depicted on the insert blank 400' as dotted lines. Insert blank 400' includes a top panel 402 and bottom panel 403. The front panel 404 spans between a pair of parallel sidewalls 406, 407. Sidewall 407 is pivotally connected to a rear panel 408 by vertical fold line 415. Rear panel 408 spans between the sidewalls 406, 407 when assembled. And rear panel 408 is disposed parallel to the front panel 404 when the box insert 400 is assembled. Each of the sidewalls 406, 407 are pivotally connected to the front panel 404 by way of parallel disposed vertical fold lines 410. A glue tab 412 is attached to sidewall 406 via vertical fold line 414. A product display panel 416 is pivotally attached to top panel 402 by way of horizontal fold line 418. Top panel 402 is pivotally attached to rear panel 402 by way of horizontal fold line 420.

Continuing with FIG. 7, support flaps 422 are connected to the sidewalls 406, 407 by way of vertical fold lines 424. The upper portion of sidewall 406, 407 include upper sidewall flaps 426. Upper sidewall flaps 426 are attached to the upper portion of the sidewalls 406, 407 by horizontal fold lines 428. The sidewalls 406, 407 include a radius portion R1, R2 extending from intersecting fold line 410,432 and to fold line 424. A support flap 430 is attached to the upper edge of front panel 404 by horizontal fold line 432. An elongated locking slot 431 is disposed along fold line 432.

Product display panel 416 includes a laterally disposed side locking flaps 434 with connected locking tabs 436. Side locking flaps 434 are interconnected to the panel 416 by way of vertical fold lines 436. Locking tabs 436 are connected to side locking flaps 434 by vertical fold lines 438. Front locking tab 440 is pivotally attached to display panel 416 by way of horizontal fold line 442.

With continued reference to FIG. 7, vertically disposed display panel locking slots 444, 446 are provided on the box insert blank 400'. Display panel locking slot 444 is disposed generally aligned with vertical fold line 414. Likewise display panel locking slot 446 is disposed generally aligned with vertical fold line 415.

Vertical fold lines 414, 410, 415, 424, 438, 436 are disposed parallel to each other. Horizontal fold lines 418, 420, 428, 432, 442 are disposed parallel to each other. It should be noted that the vertical fold lines are perpendicular to the horizontal fold lines.

Figure 9:
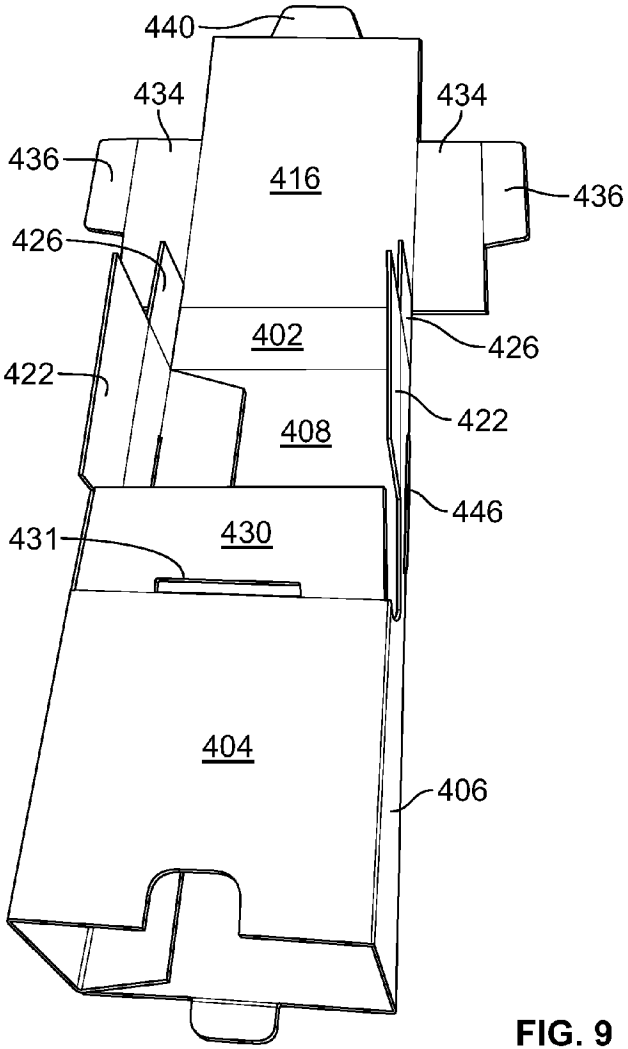
FIG. 9 is a perspective view of the box insert blank of FIG. 7 shown in a second folded state.
Figure 8:
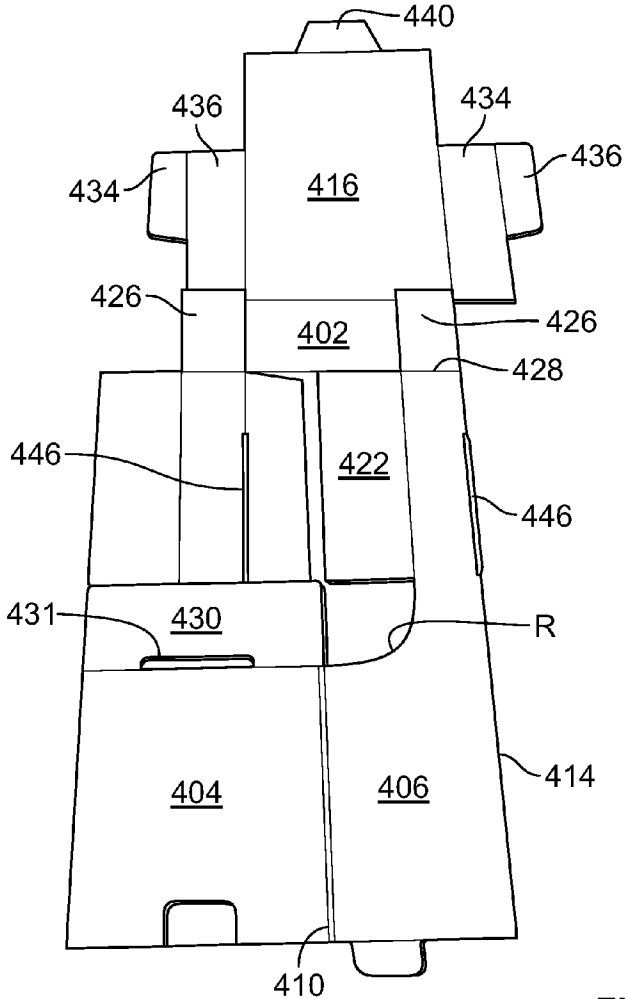
FIG. 8 is a perspective view of the box insert body blank of FIG. 7 shown in first folded state.

Referring to FIGS. 7 and 8, to begin the process of assembling the box insert 400 to form the box insert blank 400', the glue tab 412 is brought extend over rear panel 408 so that fold line 414 is brought to generally align and abut outer edge 409 to form an overlap construction of glue tab 412 and rear panel 408. Referring to FIG. 9, the box insert blank 400' is folded upward to form a tube-like structure in which the sidewalls 406, 407 are disposed extending transverse to rear panel 408.

Figure 10:
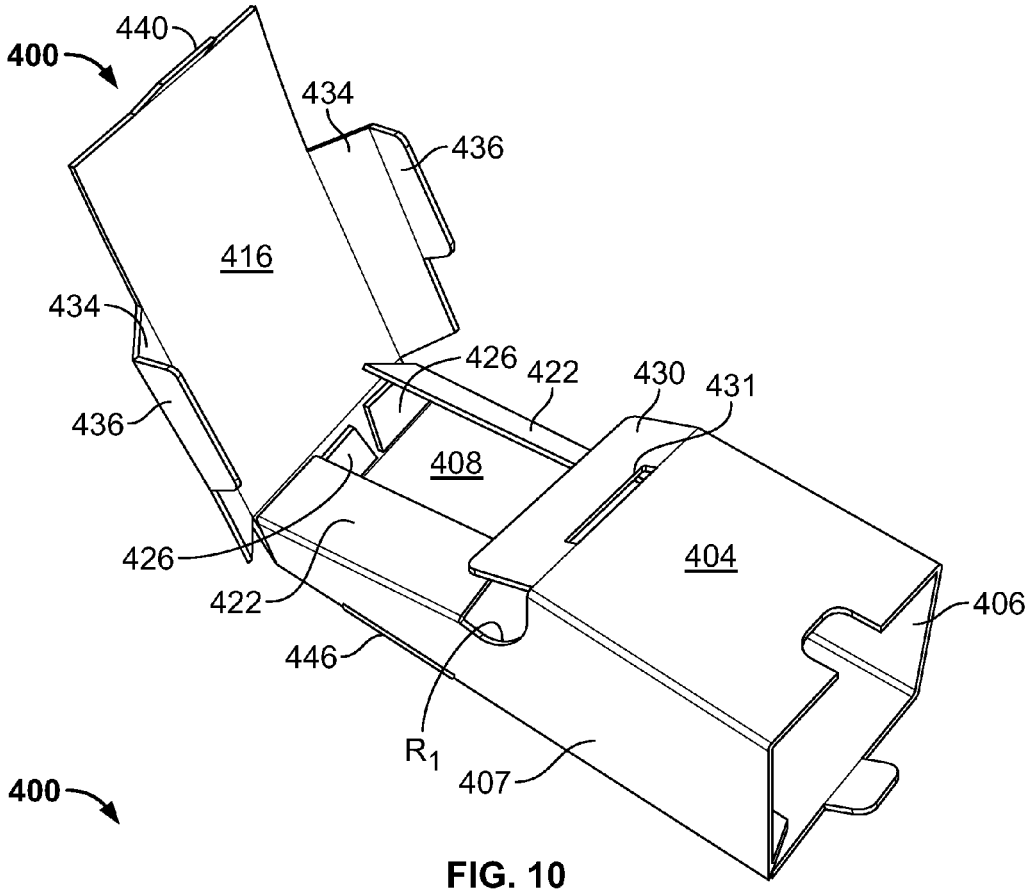
FIG. 10 is a perspective view of the box insert blank of FIG. 7 shown in a third folded state.
Figure 11:
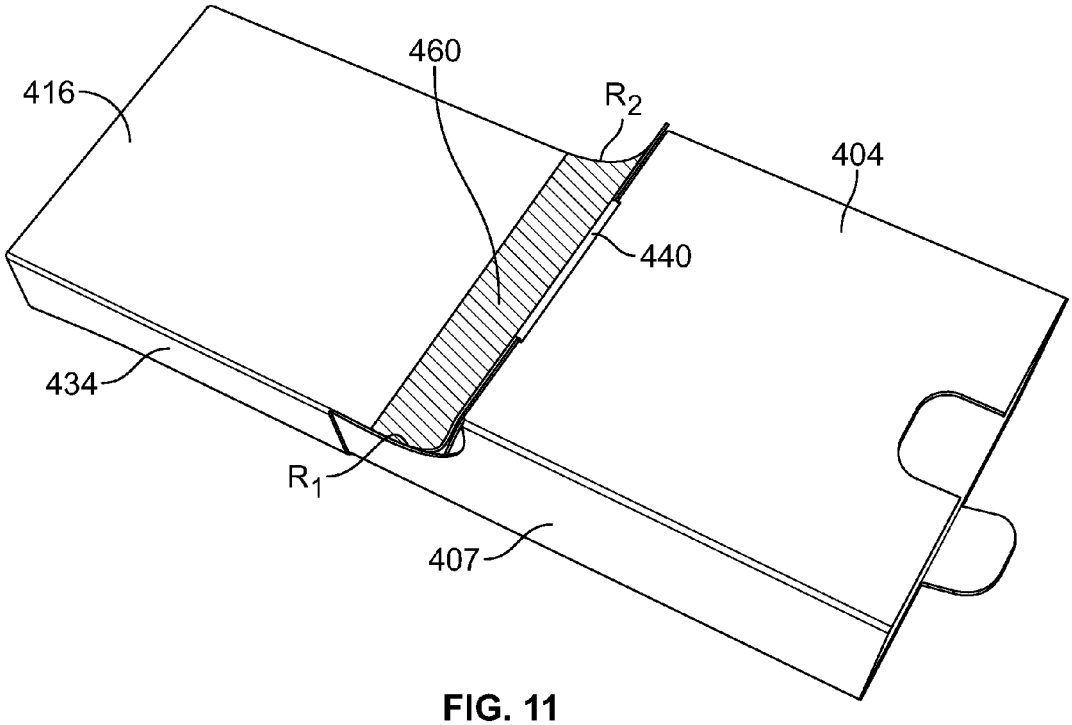
FIG. 11 is a perspective view of the box insert blank of FIG. 7 shown in an erected state.

Referring to FIGS. 10 and 11, upper sidewall flaps 426 are brought in an abutting relation underneath top panel 402. Sidewall support flaps 422 are folded over into position in which the flaps 422 may rest on edge of the upper sidewall flaps 426. The display panel 416 is pivoted towards the front panel 404 so that the locking tab 440 can be inserted through slot 431. In this arrangement, side locking flaps 434 being interconnected to the display panel 416 by way of vertical fold lines 436 can be pivoted towards sidewalls 406, 407 respectively. In this way, locking tabs 436 being connected to side locking flaps 434 by vertical fold lines 438 can be rotated towards slots 446 to interlock the display panel 416. With this configuration, display panel 416 includes a three-point locking mechanism to the remainder of box insert 400. In this arrangement, display panel 416 is pulled or tensioned along the sidewall 406, 407 fold lines 424 and becomes bent along curved portions R1, R2 so that a concave arcuate region 460 is mechanically formed. The arcuate region 460 has a curved structure that laterally extends between sidewalls 406, 407. As can be appreciated, support flaps 422 and support flap 430 provide enhanced structural strength of the display panel 416. Nevertheless, one of the locking tabs 436 can be used to interlock the display panel 416 for a two point locking arrangement, if desired.

Figure 12:
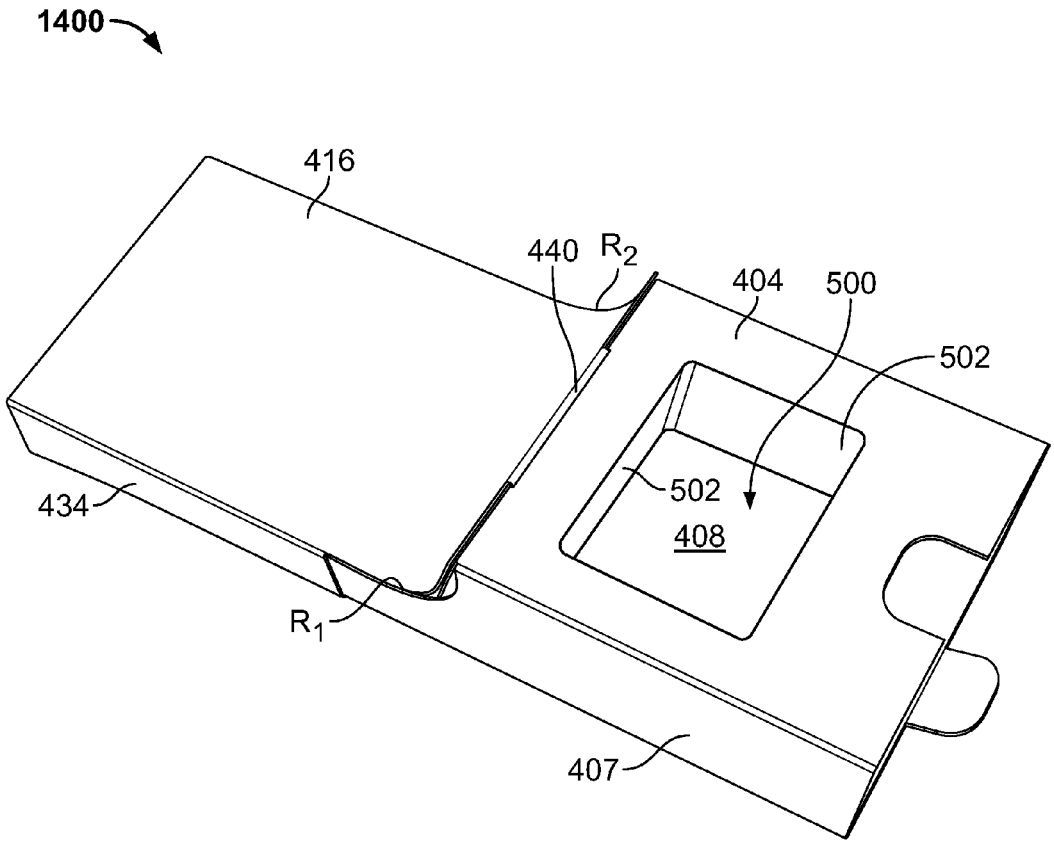
FIG. 12 is a perspective view of an alternative box insert.

Shown in FIG. 12, is an alternative embodiment of a box insert 1400 having the same basic configuration of box insert 400, except for front panel 404 includes a display cavity 500. The display cavity 500 can be any number of shapes and sizes. In this arrangement, the display cavity 500 is formed form a rectangle with four sidewalls 502 extending toward rear panel 408. The display cavity 500 can be used to retain and hold a product therein.

The combination of the display panel 416 and transparent container 300 within the outer shell 100 creates a display window box. Display panel 416 is disposed within the display frame of outer shell 200. This type of configuration provides a visual cue to the consumer so as to the contents of the container to provide an enhanced retailing experience. Additionally, this configuration obviates the apparent need for the individual purchasers from opening a retail box to view the product inside. In this manner, waste at the point of sale is reduced thereby saving costs and providing improved efficiencies.

While the subject system has been described with reference to different configurations, it will be understood by those of ordinary skill in the art that various changes may be made and equivalents may be substituted for elements thereof without departing from the scope. In addition, many modifications may be made to adapt a particular situation or material to the teachings of the described herein without departing from the scope thereof. Therefore, it is intended that the subject disclosure not be limited to the particular configurations and arrangements disclosed, but that the concepts will include all embodiments falling within the scope of the appended claims.

What is claimed is:

1. A packaging system, comprising:

a box insert formed from a sheet material, comprising:

a pair of laterally disposed sidewalls each comprising a locking slot and a concave portion;

a front panel disposed between the pair of sidewalls being connected by a vertical fold line at each sidewall; and a display panel having laterally disposed locking flaps and locking tabs that are pivotally connected to the respective locking flap by a fold line, the locking tabs are configured to be received in the locking slots of the sidewalls configured to cause the display panel to form a curved region supported by the concave portion.

2. The system of claim 1, the front panel including a front locking slot transverse to the locking slots of the sidewalls.

3. The system of claim 2, the display panel further comprising a front locking tab being perpendicular to the locking tabs and the front locking tab being received in the front locking slot of the front panel.

4. The system of claim 1, further comprising a plastic container wherein the box insert is configured to be disposed within the plastic container.

5. The system of claim 4, the plastic container further comprising a top panel having an elongated slot therein configured to receive a hanging tab.

6. The system of claim 5, the plastic container further comprising a support panel being pivotally connected to the top panel and to the hanging tab.

7. The system of claim 5, the plastic container further comprising a pair of sidewalls including laterally disposed top flaps collectively defining a second slot being aligned with the elongated slot.

8. A packaging system, comprising:

an outer shell comprising a display frame window;

a plastic container being disposed inside of the outer shell; the plastic container having mounted therein, a box insert formed from a sheet material, comprising:

a pair of laterally disposed sidewalls each including a locking slot and a concave portion;

a front panel disposed between the pair of sidewalls being connected by a vertical fold line at each sidewall;

a display panel having laterally disposed locking flaps and locking tabs that are pivotally connected to the respective locking flap by a fold line, the locking tabs are configured to be received in the locking slots of the sidewalls and configured to cause the display panel to form a curved region supported by the concave portion; the display panel being disposed within the display frame window.

9. The system of claim 8, the plastic container comprising a mechanically interconnected hanging tab.

10. The system of claim 8, the outer shell further comprising a paperboard material.

11. The system of claim 8, the front panel further comprising a front locking slot transverse to the locking slots of the sidewalls.

12. The system of claim 11, the display panel further comprising a front locking tab being perpendicular to the locking tabs and the front locking tab being received in the front locking slot of the front panel.

13. The system of claim 8, wherein the front panel further comprises a display cavity therein.

14. The system of claim 8, the plastic container further comprising a top panel having an elongated slot therein configured to receive a hanging tab.

15. The system of claim 14, the plastic container further comprising a support panel being pivoting connected to the top panel and to the hanging tab.

16. The system of claim 15, the plastic container further comprising a pair of sidewalls including laterally disposed top flaps.

* * * * *